United States Patent [19]

Noack et al.

[11] 3,939,317

[45] Feb. 17, 1976

[54] ELECTRIC COMPRESSED-GAS CIRCUIT BREAKER

[75] Inventors: Dieter Noack; Heiner Marin, both of Berlin, Germany

[73] Assignee: Siemens Aktiengesellschaft, Munich, Germany

[22] Filed: Sept. 12, 1974

[21] Appl. No.: 505,386

[30] Foreign Application Priority Data

Sept. 18, 1973 Germany ..... 2347605

[52] U.S. Cl. ..... 200/148 A; 200/148 R

[51] Int. Cl.[2] ..... H01H 33/88

[58] Field of Search ..... 200/148 A, 148 R

[56] References Cited

UNITED STATES PATENTS 2,913,559 11/1959 Cromer ..... 200/148 A 3,739,124 6/1973 Richter et al. ..... 200/148 A

*Primary Examiner*—Robert S. Macon

*Attorney, Agent, or Firm*—Kenyon & Kenyon Reilly Carr & Chapin

[57] ABSTRACT

An electric compressed-gas circuit breaker is equipped with a blasting device for extinguishing the arc drawn when the breaker opens. The blasting device includes a cylinder member and a piston member as well as energy storage means which, at the start of the opening motion, is released in a direction to produce an additional compression. The energy storage means is charged at the end of the breaker opening motion with the kinetic energy of the parts moved by the drive for the blasting device.

6 Claims, 7 Drawing Figures

ELECTRIC COMPRESSED-GAS CIRCUIT BREAKER

BACKGROUND OF THE INVENTION

The invention relates to an electric compressed-gas circuit breaker with a quenching device which includes a movable blasting cylinder, a so-called puffer cylinder, and a puffer piston controlled in an axial motion relative to the puffer cylinder. The contact arrangement of the breaker includes a fixed contact piece and a movable contact piece. A drive for the quenching device is also provided.

From Deutsche Offenlegungsschrift No. 1,913,973 an electric circuit breaker is known whose quenching device, consisting of a puffer piston and the puffer cylinder, is coupled with the drive for the compression of the quenching medium in such a manner that the distance of the puffer piston from the mating contact piece is greater in the closed and in the open position than during the interrupting process. One thereby obtains an improvement of the compression of the quenching medium, because a motion in opposite directions takes place between the piston and the puffer cylinder during the pre-compression phase. For this purpose, not only the puffer cylinder is rigidly coupled with the drive, but the puffer piston is also connected with the drive by means of a special linkage. This means that the entire energy for the compression of the quenching medium must be supplied by the drive at the same time.

SUMMARY OF THE INVENTION

It is an object of the invention to provide an electric compressed-gas circuit breaker of the above-mentioned type wherein the energy that must be made available by the drive during the interrupt motion can be reduced while retaining the advantage of rapid compression and without reducing the switching capacity of the breaker.

According to the invention, the above objects are realized by an energy storage device which is arranged between the puffer piston and the puffer cylinder and releases at the beginning of the interrupt motion in the sense of additional compression, and which can be charged at the end of the interrupt motion with the kinetic energy of the parts moved by the drive.

Through the use of the invention, kinetic energy of the parts moved by the drive, which is customarily removed in conventional breakers by means of damping means, can be released, that is, utilized for the following switching operation for increasing the driving force.

In a preferred embodiment, the energy storage device is positively controlled by the drive; this assures that the charge absorbed by the energy storage device is released under positive control in the course of the pre-compression phase of the quenching device.

In a particularly advantageous embodiment of the extinguishing device according to the invention, the energy storage device is a compression spring which is arranged between the puffer piston and the puffer cylinder and which can be tensioned toward the end of the opening motion, preferably by the movable contact. Here, the puffer cylinder of the quenching device is preferably coupled rigidly with the drive, while the puffer piston can be latch-locked against stationary parts of the breaker. It is also possible, of course, to couple the puffer piston rigidly with the drive and to latch-lock the puffer cylinder detachably at stationary parts of the breaker. It is advantageous to construct the puffer piston as a ring piston surrounding the movable contact; the former is then taken along under forced control by the movable contact piece toward the end of the interrupt motion. A roller-controlled latch is advantageously associated with the energy storage device for controlling the puffer piston and the energy storage device connected with it.

Although the invention is illustrated and described herein as an electric compressed-gas circuit breaker, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
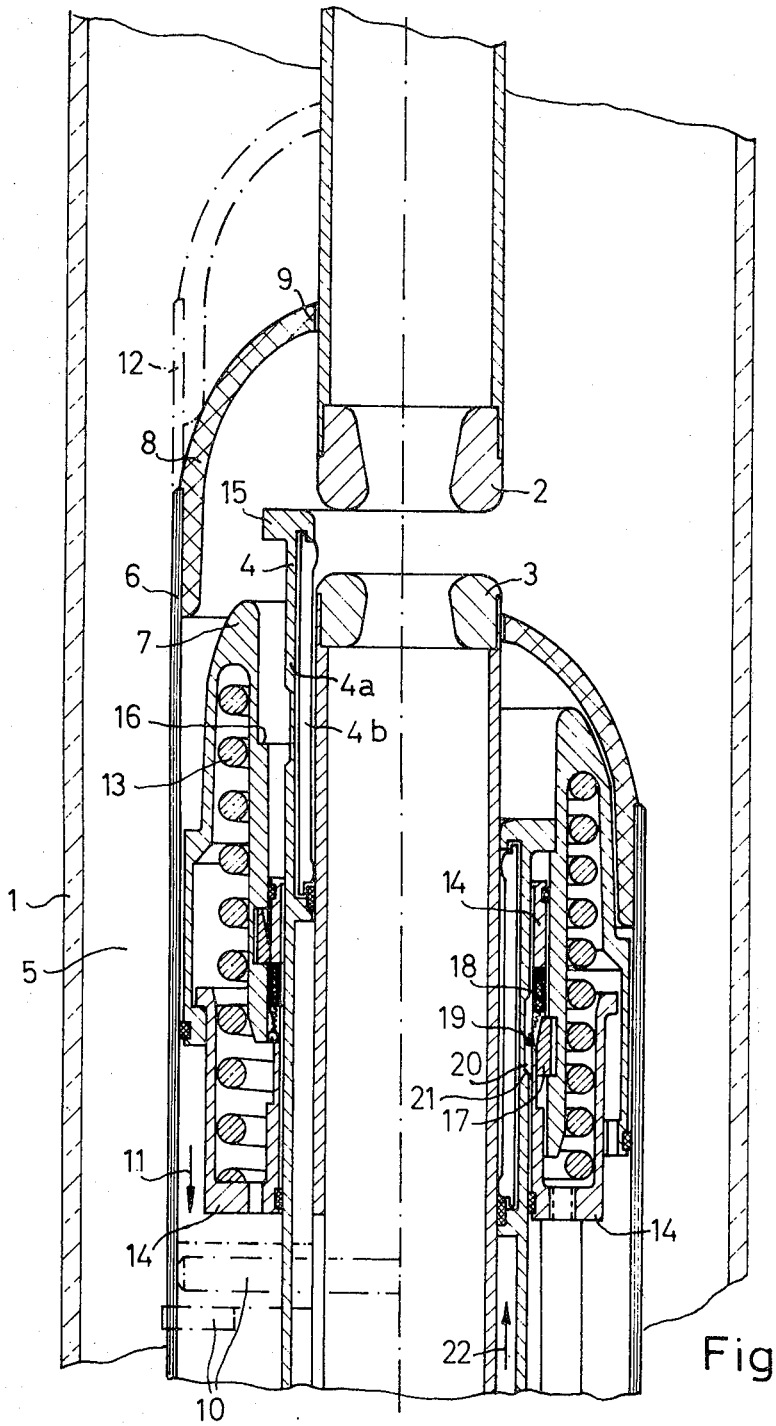
FIG. 1 is a schematic diagram of a compressed-gas circuit breaker equipped with an extinguishing device according to the invention. The component parts to the left of the center line are depicted to show their position during a movement from the closed position to the open position of the breaker. The phantom outline therein indicates the position of the blast cylinder member for the open position. To the right of the center line, the parts of the extinguishing device are shown in the position they occupy when the breaker is in the open position.

In FIG. 1, the electric compressed-gas circuit breaker is shown to the right of the center line in the open position and to the left of the center line, shortly after the start of the opening motion. The compressed-gas circuit breaker includes a switching chamber 1 consisting of porcelain, which supports at its upper end a fixed contact 2. A fixed contact 3 is arranged on the axis common to both contacts 2 and 3 and is attached at the lower end of the chamber in spaced relation to contact 2. The distance between the two constacts 2 and 3 constitutes the gap which, in the closed position of the breaker, is bridged by an essentially tubular bridging switching member 4 in an electrically conducting manner. The interior 5 of the switching chamber 1 is filled with an insulating gas, particularly, an electronegative gas such as sulfur hexafluoride at a pressure of about 4 bar. With the contact system of the two stationary contacts 2 and 3 and the movable bridging switching member 4 there is associated a quenching device. The quenching device includes a movable puffer cylinder 6 and a puffer piston 7. The puffer cylinder 6 carries at its end face a nozzle member 8 having a nozzle opening 9 tightly surrounding the stationary contact 2 in the closed position and in the course of the pre-compression phase. The puffer cylinder 6 is moved, together with the bridging switching member 4, by an actuator 10 in the direction of the arrow 11 when the electric circuit breaker receives the command to open. In this operation, the puffer cylinder 6 first moves from the position 12 shown by the broken line to the left of the center line into the position shown schematically by the solid line (also to the left of the center line) whereat the bridging switching member 4 releases the pre-compressed gas in a direction toward the gap between the contacts 2 and 3 while at the same time interrupting the circuit. The bridging switching member 4 is made of a tubular sleeve **4*a* and contact fingers 4*b*** resiliently supported therein. A switching member of this type is described, for example, in U.S. Pat. No. 3,789,175.

The puffer piston 7 rests against a stationary stop 14 of the compressed-gas circuit breaker by means of a compression spring 13. To the left of the center line, the spring 13 is shown in the relaxed condition. The puffer piston 7 is arranged relative to the stationary stop 14 so as to be movable axially with respect to the puffer cylinder 6. The compression spring 13 loading the puffer piston 7 acts as an energy storage device which is charged in the further course of the opening motion. For this purpose, the bridging switching member 4 is provided with a circular, radially projecting rim 15, which is pressed against the stop shoulder 16 of the puffer piston 7 and thus transfers the puffer piston 7 from the position shown to the left of the center line into a position shown to the right of the center line. In the position shown to the right of the center line, the puffer piston 7 is latch-locked by means of a ring 17 acting as a latch on the stationary stop 14. The ring 17 is expandable as described below and can be made of a material such as spring steel.

This lock can be released by balls 19 which rest against the stationary stop 14 and which are loaded by means of a spring 18 having a housing **18*a*. The balls 19 have a clearance in the locked position in a cutout 20 on the bridging switching member 4 and are taken along by the release flank 21 of the cutout 20 against the force of the spring 18. In the course of a movement of the bridging switching member 4 taking place in the direction of the arrow 22, the lock is retained and is released only upon a new movement of the bridging switching member 4 in the direction of the arrow 11**.

This action can be seen with particular clarity from the half-section views shown in FIGS. 2 to 5 wherein the same parts are labelled with the same reference symbols.

Figure 2:
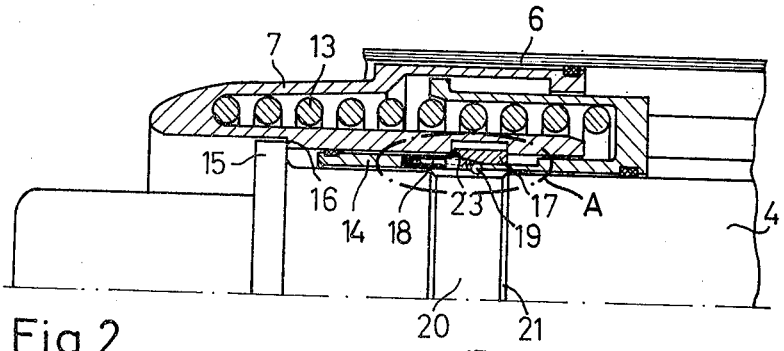
FIG. 2 is a half-elevation view, partially in section, showing the position of the blast piston member relative to the bridging switching piece when the breaker is in the open position.
Figure 3:
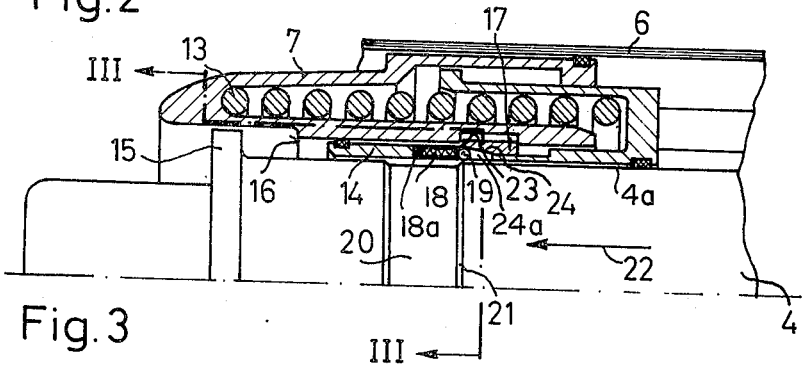
FIG. 3 shows the same parts as shown in FIG. 2 for the condition existing after the breaker closing operation has begun. This view is taken along line II—II of FIG. 3A.
Figure 4:
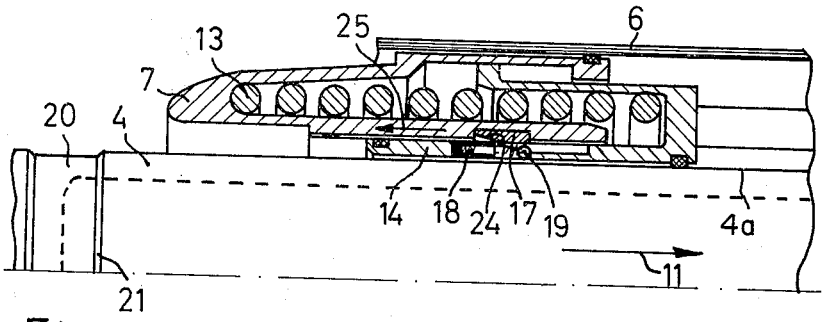
FIG. 4 shows how the piston of the extinguishing device is released at the beginning of the opening operation of the breaker.
Figure 5:
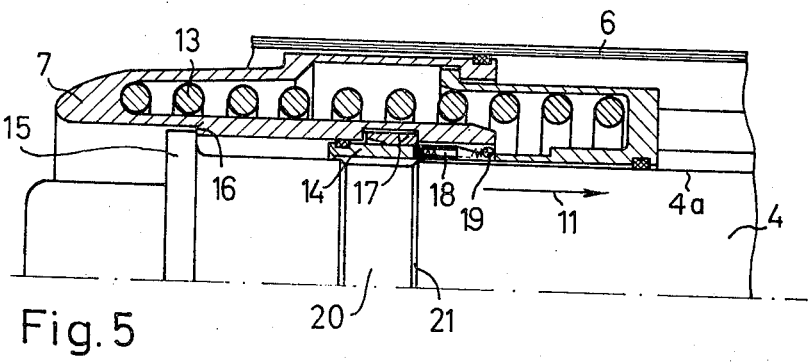
FIG. 5 is also a half-elevation view showing the position of the blast piston member and bridging switching piece as the latter engages the former during the breaker opening operation.
Figure 2A:
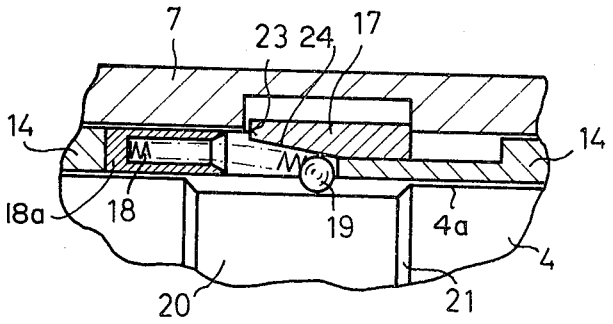
FIG. 2A is an exploded view of the encircled portion of FIG. 2 and shows how the latching mechanism latches the blast piston member when the bridging switching piece is brought into the open position.
Figure 3A:
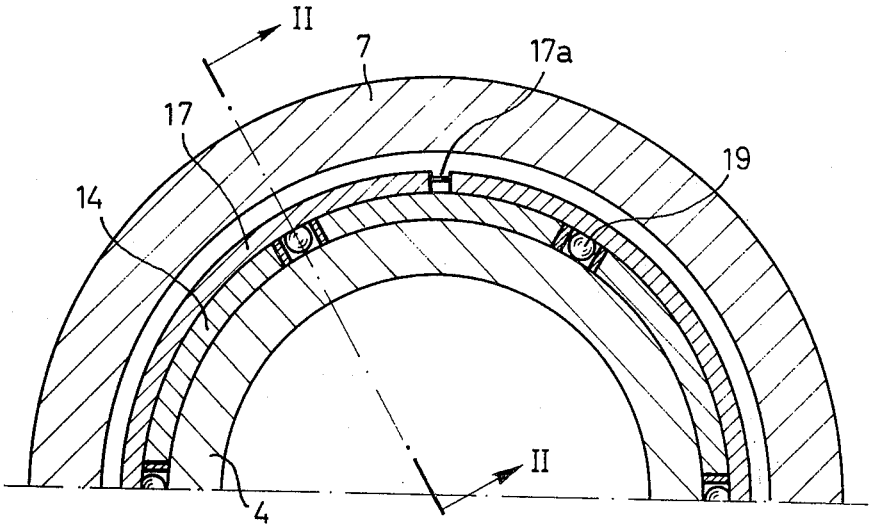
FIG. 3A is a section view taken along line III—III of FIG. 3 to show the distribution of the balls of the latching mechanism and their disposition with respect to the stationary stop 14.

FIG. 2 shows the open position of the breaker in which the circular, projecting rim 15 of the bridging switching member 4 is pressed against the shoulder 16 of the puffer piston 7 so that the piston 7 latches on stationary part 14 by means of the ring 17 with its edge 23 (FIG. 2A). In the course of the closing motion, the bridging switching member 4 is moved in the direction of the arrow 22, the ball being displaced from the cutout 20 to the locking edge 23 with a rolling motion while the spring 18 is compressed into its housing **18*a* as shown in FIG. 3. At the location next to housing 18*a*, there is sufficient room to accommodate the ball 19 between surface 4*a* and the runoff edge 24 so that the expandable ring 17 does not become disengaged from stationary part 14. The rolling motion which moves the ball 19 to the location next to housing 18*a* is achieved by the action on the ball 19 of the release flank 21 and the outer surface 4*a* of the switching member 4. Surface 4*a* imparts a rolling motion to balls 19 because, as shown in FIG. 3A, the balls are in rolling contact therewith. The ball 19 remains in the location next to housing 18*a* until the start of the opening motion (FIG. 4**).

FIG. 3A shows the balls 19 and how they are distributed as well as their disposition with respect to the stationary part 14. FIG. 3A also shows the ring 17 being expandable by a slit **17*a***.

Referring again to FIG. 4, at the start of the opening motion, the bridging switching member 4 is moved in the direction of the arrow 11 thereby causing surface **4*a* to impart a rolling motion to ball 19; this in turn causes ball 19 to roll against the run-off edge 24 of the ring 17 and simultaneously relaxes the spring 18; this rolling action of ball 19 causes the ball 19 to move ever further toward the apex of the wedge-like opening 24*a* conjointly defined by the edge 24 and surface 4*a*. In this way, the ball presses against edge 24 to expand the ring 17 in such a manner that the locking edge 23 is disengaged. The puffer piston 7 is moved thereby (at the start of the opening motion) in the direction of the arrow 25 in such a manner that the energy stored in the spring 13** is released in the sense of an additional compression.

Toward the end of the opening motion, the parts of the compressed-gas circuit breaker, that is, the puffer cylinder 6, the bridging switching member 4 and their common driving linkages, which are moved by the drive 10, are decelerated by the spring 13 loading the puffer piston 7; more specifically, the kinetic energy of the parts moved by the drive charges the energy storage device constituted by the spring 13.

In this manner, the drive can be constructed for smaller forces with the switching capacity of the electric compressed-gas breaker remaining the same; or the breaker is suited, through the application of the invention, for more rapid compression with drive elements of the same size, which corresponds to a shortening of the interrupt time.

What is claimed is:

1. In an electric compressed-gas circuit breaker having a contact arrangement including a movable switching piece and a stationary contact piece and being equipped with a drive actuated extinguishing device for extinguishing the arc drawn as the breaker switches from the closed position to the open position, the extinguishing device comprising: a movable blast cylinder member; a blast piston member axially movable relative to said blast piston; a drive connected to one of said members and to said switching piece for moving the same when the breaker is moved between the opened and closed positions thereby imparting kinetic energy thereto during the movement between said positions; energy storage means for receiving and storing at least a portion of said energy in a manner so as to load the other one of said members therewith; engaging means for engaging said other one of said members to move the same in a direction to load said energy storage means with said kinetic energy toward the end of the movement from said closed position to said open position; and, latching means for releasing said stored energy at the beginning of the next movement from said closed position to said open position to cause said other member to be propelled by said stored energy in a direction opposite to said one member whereby additional compression of the gas is achieved.

2. The extinguishing device of claim 1, said energy storage means being a resilient element arranged between said other member and a stationary location on the breaker, said engaging means comprising means formed on the movable switching piece for engaging said other member toward the end of said movement from said closed position to said open position whereby said other member acts upon said resilent member to stress the same thereby storing at least a portion of said kinetic energy therein.

3. The extinguishing device of claim 2, said resilient element being a compression spring tensioned in compression by the action of said other member thereon after said other member is engaged by said means formed on the movable switching piece.

4. The extinguishing device of claim 3, said one member is said blast cylinder member and said other one of said members is said blast piston member, said blast cylinder member being rigidly coupled to said drive, said latching means comprising means for latching said blast piston member to a stationary location on the breaker when the movable switching piece arrives at said open position.

5. The extinguishing device of claim 4, said blast piston member being configured as an annular piston arranged in surrounding relation to said movable switching piece, said means formed on the movable switching piece being a projection for engaging said blast piston member toward the end of said movement from said closed position to said open position to forcibly move said blast piston member against the force of said compression spring.

6. The extinguishing device of claim 4 wherein the breaker includes a stationary part, said latching means including a stop formed on said stationary part; an expandable ring mounted on said blast piston member for forcibly engaging said stop after said piston member is moved by the movable switching piece to load said compression spring; and, roller means for coacting with said ring in response to the next movement of the movable switching piece from said closed position to said open position to cause said expandable ring to expand so as to disengage the same from said stop thereby releasing the energy stored in said compression spring whereby said blast piston member is propelled in a direction opposite to said blast cylinder member at the beginning of said last-mentioned movement.

* * * * *